US011029649B2

(12) United States Patent
Semon et al.

(10) Patent No.: US 11,029,649 B2
(45) Date of Patent: Jun. 8, 2021

(54) DEVICE FOR TIMEPIECE, CLOCKWORK MOVEMENT AND TIMEPIECE COMPRISING SUCH A DEVICE

(71) Applicant: LVMH Swiss Manufactures SA, La Chaux-de-Fonds (CH)

(72) Inventors: Guy Semon, Evette-Salbert (FR); Wout Johannes Benjamin Ypma, XB Delft (NL); Sybren Lennard Weeke, NC Blijham (NL); Nima Tolou, AC The Hague (NL)

(73) Assignee: LVHM SWISS MANUFACTURES SA, La Chaux-de-Fonds (CH)

( * ) Notice: Subject to any disclaimer, the term of this patent is extended or adjusted under 35 U.S.C. 154(b) by 317 days.

(21) Appl. No.: 16/084,140

(22) PCT Filed: Mar. 13, 2017

(86) PCT No.: PCT/EP2017/055876
§ 371 (c)(1),
(2) Date: Sep. 11, 2018

(87) PCT Pub. No.: WO2017/157870
PCT Pub. Date: Sep. 21, 2017

(65) Prior Publication Data

US 2020/0333746 A1 Oct. 22, 2020

(30) Foreign Application Priority Data

Mar. 14, 2016 (FR) ..... 16 52134

(51) Int. Cl.
*G04B 17/32* (2006.01)
*G04B 17/04* (2006.01)

(52) U.S. Cl.
CPC ..... *G04B 17/32* (2013.01); *G04B 17/045* (2013.01)

(58) Field of Classification Search
CPC ..... G04B 17/32; G04B 15/14; G04B 17/04; G04B 17/045; G04B 18/00; G04B 18/02; G04B 18/006; G04B 18/08
See application file for complete search history.

(56) References Cited

FOREIGN PATENT DOCUMENTS

| | | | |
|---|---|---|---|
| CH | 709 282 | A2 | 9/2015 |
| EP | 1 736 838 | A1 | 12/2006 |
| EP | 2 090 941 | A1 | 8/2009 |
| EP | 2 273 323 | A2 | 1/2011 |
| EP | 2 781 969 | A1 | 9/2014 |
| FR | 2 106 507 | A1 | 5/1972 |
| WO | WO 2017055983 | A1 | 4/2017 |

OTHER PUBLICATIONS

Machine Translation of EP2273323 (Year: 2011).*
International Search Report related to Application No. PCT/EP2017/055876; dated Jun. 7, 2017.

* cited by examiner

*Primary Examiner* — Edwin A. Leon
*Assistant Examiner* — Jason M Collins
(74) *Attorney, Agent, or Firm* — Miller, Matthias & Hull LLP

(57) ABSTRACT

Device for timepiece comprising a monolithic mechanism which comprises a support and an inertial regulating member connected to the support by an elastic suspension. The elastic suspension comprises an elastic adjustment link having a first end adjustable relative to the support, so as to change the overall stiffness of the elastic suspension and therefore the oscillation frequency of the inertial regulating member.

17 Claims, 7 Drawing Sheets

X
Y
Z
VII A

DEVICE FOR TIMEPIECE, CLOCKWORK MOVEMENT AND TIMEPIECE COMPRISING SUCH A DEVICE

CROSS-REFERENCE TO RELATED APPLICATION

This application is a 35 USC § 371 US National Stage filing of International Application No. PCT/EP2017/055876 filed on Mar. 13, 2017, and claims priority under the Paris Convention to French Patent Application No. 1652134 filed on Mar. 14, 2016.

FIELD OF THE DISCLOSURE

The present invention relates to devices for timepieces, and also to clockwork movements and timepieces comprising such devices.

BACKGROUND OF THE DISCLOSURE

Devices are known for timepieces comprising a monolithic mechanism which comprises:

a support;

at least one inertial regulating member;

an elastic suspension linking said at least one inertial regulating member to the support and having a specific overall stiffness;

where said at least one inertial regulating member is suited to oscillate at a frequency f relative to the support.

Document US 2013/176829 A1 describes an example of such a device.

The known devices of this type have the disadvantage that manufacturing tolerances induce dispersions in the oscillation frequency f, and therefore in the temporal precision of the device.

The purpose of the present invention is especially to remedy this drawback.

SUMMARY OF THE DISCLOSURE

For this purpose, according to the invention, a device of the type in question is characterized in that the elastic suspension comprises an elastic adjustment link having a first end linked to said at least one inertial regulating member and a second end which is connected to the support by a frequency adjustment device suited to modify the position of the second end of said elastic adjustment link relative to the support, so as to change the overall stiffness of the elastic suspension and therefore said frequency f.

Because of these dispositions, the oscillation frequency f can be adjusted and therefore the dispersions due to the manufacturing tolerances compensated.

In various embodiments the mechanism according to the invention, one and/or another of the following dispositions could further be used:

the frequency adjustment device includes a frequency adjustment member which is linked to the second end of said elastic adjustment link, where said frequency adjustment member is adjustable in position relative to the support so as to be able to deform said elastic adjustment link;

said frequency adjustment member is mounted movably relative to the support and comprises a blocking device suited to block the frequency adjustment member relative to the support;

said blocking device comprises a screw;

said frequency adjustment member is connected to the support by an eccentric link suited to be blocked by said screw;

the monolithic mechanism additionally comprises a pallet suited for engaging with an energy distribution member provided with teeth and intended to be urged by an energy storage device, where said pallet is controlled by said at least one inertial regulating member for uniformly and alternately blocking and releasing the energy distribution member, such that said energy distribution member moves stepwise under the urging of said energy storage device according to a repetitive movement cycle, and where said pallet is suited for transferring said mechanical energy to at least one inertial regulating member during this repetitive movement cycle;

the device comprises first and second inertial regulating members connected to each other so as to always have symmetrical and opposed movements;

The first inertial regulating member controls the pallet,

The second inertial regulating member controls a balancing member for moving said balancing member according to movements symmetrical and opposed to the pallet, And said elastic adjustment link comprises at least one of the first and second elastic parts, with the first elastic part connecting the second inertial regulating member to the balancing member and with the second elastic part connecting said balancing member to the frequency adjustment device;

the first and second inertial regulating members are mounted on the support in order to oscillate in translation in a first translation direction, The pallet and the balancing member are elastically mounted on the support in order to oscillate in translation in a second translation direction substantially perpendicular to the first translation direction, And the frequency adjustment device is suited for adjusting the position of the second end of the elastic adjustment link relative to the support at least parallel to the second translation direction;

each of the first and second inertial regulating members is mounted on the support by two elastic suspension branches substantially perpendicular to the first translation direction, Where the pallet and the balancing member are respectively mounted on the support by two elastic suspension branches substantially perpendicular to the second translation direction;

said second elastic part of the elastic adjustment link comprises at least one U-shaped part, comprising two branches substantially parallel to the first translation direction, having free ends which are connected respectively to the frequency adjustment member and the balancing member;

the first and second inertial regulating members are connected to each other by a pivoting balancing lever;

the pallet and the balancing member are respectively linked to the first and second regulating members by first and second elastic drive branches;

the adjustment member and the support comprise facing indexes suited for visually assessing the position of the adjustment member relative to the support;

the mechanism extends along a median plane and the inertial regulating member substantially has an axial symmetry of order n about a central axis orthogonal to said median plane and fixed relative to the support, where n is an integer at least equal to 2, where said inertial regulating member comprises a number n of stiff portions connected to each other pairwise by n elastic coupling links, and where the elastic suspension comprises n elastic suspension links respectively connecting each stiff portion of the support;

the frequency adjustment device comprises a frequency adjustment member mounted substantially adjustably by pivoting around a pivoting axis and having a main body extending between a first extremity located near the pivoting axis and a second extremity adjustable in position, where the frequency adjustment member additionally comprises a lever arm which extends from the first end to opposite from the second end 153*b*, where the lever arm is linked to the second end of said elastic adjustment link, and where said lever arm is shorter than the main body of the frequency adjustment member.

Furthermore, the invention also relates to a clockwork movement comprising the device such as described above and said energy distribution member.

Finally, the invention also relates to a timepiece comprising a movement such as defined above.

BRIEF DESCRIPTION OF THE DRAWINGS

Other features and advantages of the invention will become apparent during the following description of two of the embodiments thereof, given as a nonlimiting example, with reference to the attached drawings.

In the drawings.

DETAILED DESCRIPTION

In the various figures, the same references designate identical or similar items.

Figure 1:
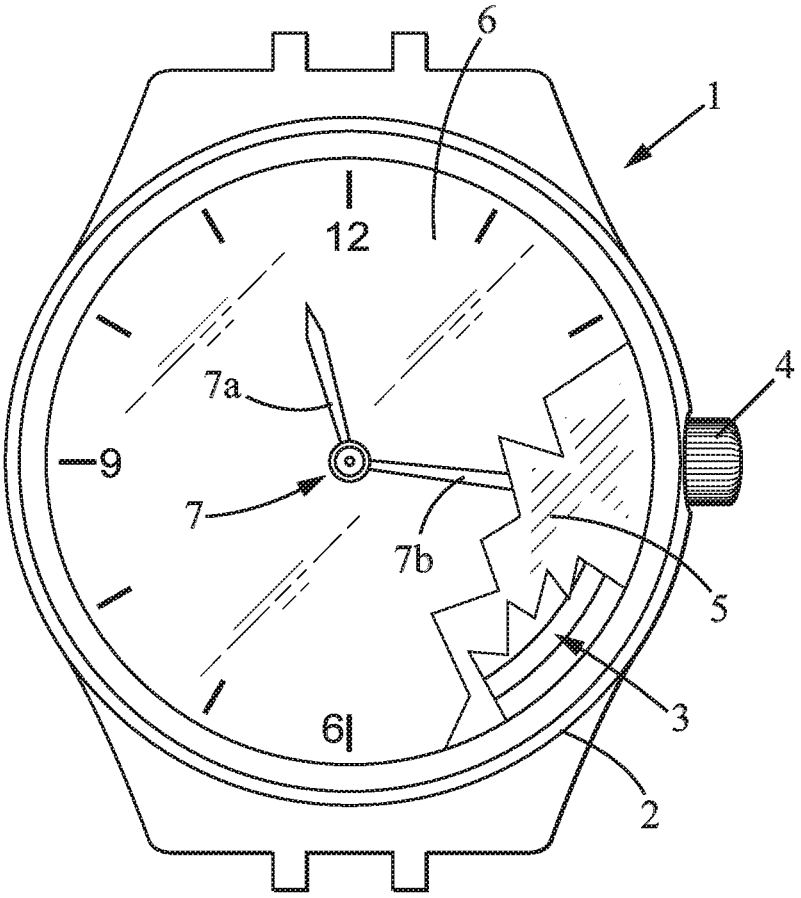
FIG. 1 is a schematic view of a timepiece which can comprise a mechanism according to an embodiment of the invention.

FIG. 1 shows a timepiece 1 such as a watch, comprising:

a case 2;

a clockwork movement 3 contained in the case 2;

generally, a winder 4;

a dial 5;

a glass 6 covering the dial 5;

a time indicator 7, comprising for example two hands 7*a*, 7*b* respectively for the hours and the minutes, arranged between the glass 6 and the dial 5 and actuated by the clockwork movement 3.

Figure 2:
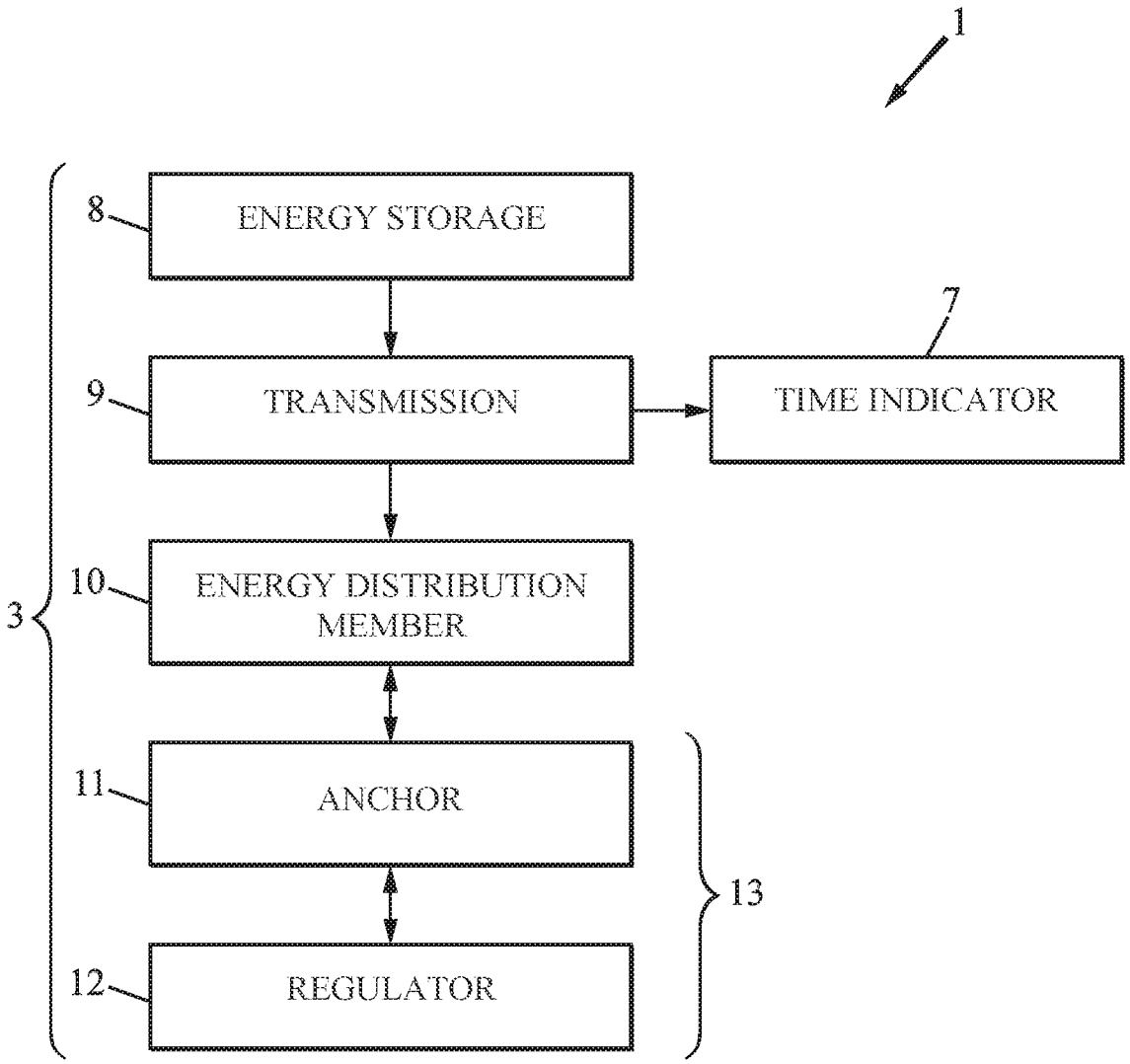
FIG. 2 is a block drawing of the movement from the timepiece from FIG. 1.

As shown schematically in FIG. 2, the clockwork movement 3 can comprise for example:

a mechanical energy storage device 8, generally a barrel spring;

a mechanical transmission 9 moved by the mechanical energy storage device 8;

the aforementioned time indicator 7;

an energy distribution member 10 (for example an escapement wheel);

a pallet 11 suited for sequentially retaining and releasing the energy distribution member 10;

a regulator 12, which is a mechanism comprising an oscillating regulating member controlling the pallet 11 in order to move it regularly such that the energy distribution member is moved stepwise in constant time intervals.

The pallet 11 and the regulator 12 form a monolithic mechanism 13, as will be explained below.

The clockwork movement 3 is now going to be explained in more detail with the help of FIG. 3, which represents a specific case where the mechanism 13 (outside of the screw blocking mechanism described below) is a monolithic system formed of a single plate 14 (usually flat) and the mobile parts are designed for moving essentially in a median plane of said plate 14.

The plate 14 can be thin, for example about 0.05 mm to about 1 mm, according to the type of material for the plate 14.

The plate 14 can have transverse dimensions, in the XY plane of the plate (in particular length and width, or diameter), included between about 10 mm and 40 mm. X and Y are two perpendicular axes defining the plane of the plate 14.

The plate 14 can be made from any suitable stiff material preferably having a small Young's modulus for presenting good elasticity properties and a low oscillation frequency. Examples of materials that can be used to make the plate 14 include silicon, nickel, iron-nickel alloy, steel and titanium. In the case of silicon, the thickness of the plate 14 may for example be included between 0.2 mm and 0.6 mm.

The various members formed in the plate 14 are obtained by making openings in the plate 14 obtained by any fabrication method used in micromechanics, in particular methods used for MEMS fabrication.

In the case of a plate 14 of silicon, the plate can be locally hollowed and milled for example by deep reactive ion etching (DRIE) or possibly by laser cutting for small fabrication runs.

In the case of a plate 14 of iron-nickel, the plate could in particular be made by the LIGA method, or by laser cutting.

In the case of a plate 14 of steel or titanium, the plate 14 can be hollowed for example by wire electrical discharge machining (WEDM).

The constituent parts of the mechanism are now going to be described in more detail. Some of these parts are stiff and others (in particular those called "elastic branches") are elastically deformable, mainly in flexion. The difference between the stiff parts and the elastic parts is the stiffness thereof in the XY plane of the plate 14, which is due to the shape thereof and in particular the slenderness thereof. The slenderness can in particular be measured by the slenderness ratio (ratio of length to width of the part in question). For example, the stiff parts have a stiffness in the XY plane at least about 100 times higher than the elastic parts. Typical dimensions for the elastic links, for example the elastic branches which will be described below, include lengths included for example between 5 and 13 mm and widths included for example between 0.01 mm (10 μm) and 0.04 mm (40 μm), in particular about 0.025 mm (25 μm). Considering the width of the beams and the thickness of the plate 14, the aspect ratio of these beams in longitudinal section is included between 5 and 60. The largest possible aspect ratio is preferred in order to limit the out of plane oscillation modes.

The plate 14 forms a fixed outer frame 15 which is fastened to a support plate 14*a*, for example by screws or the like (not shown) passing through holes 15*a* of the frame 15. The support plate 14*a* is securely joined to the case 2 of the timepiece 1. The frame 15 can at least partially surround the energy distribution member 10, the pallet 11 and the regulator 12.

The energy distribution member 10 can be an escapement wheel rotationally mounted for example on the support plate 14*a*, so as to be able to turn around a rotation axis Z0 perpendicular to the XY plane of the plate 14. The energy distribution member 10 is urged in a single direction of rotation 16 by the energy storage [device] 8.

The energy distribution member 10 has outer teeth 17.

The pallet 11 is a stiff part which can comprise a stiff body 18 extending for example parallel to the X-axis and two parallel stiff lateral arms 19, 20 extending for example parallel to the Y-axis on either side of the energy distribution member 10. The arms 19, 20 respectively comprise two stop members 21, 22 shaped like fingers projecting towards each other from the arms 19, 20 in the X-axis direction.

The pallet 11 is elastically connected to the frame 15 so as to be able to move parallel to the X-axis in a translation direction O2. Advantageously, the pallet 11 can be connected to the frame 15 by an elastic suspension, comprising for example two elastic branches 23 substantially parallel to the Y-axis. Possibly, the elastic branches 23 can be connected to the body 18 and arranged on either side of the lateral arms 19, 20 by framing these lateral arms.

The pallet 11 can additionally comprise a stiff arm 24 extending along the Y-axis towards the regulator 12, opposite from arm 20.

The pallet 11 can additionally comprise a monostable elastic member 11*a*, which can have the shape of an elastic tab whose free end comes to bear on the teeth 17 of the energy distribution member 10. The monostable elastic member 11*a* can be connected to the stiff arm 19 of the pallet 11, for example by an elastic suspension comprising two parallel elastic branches 11*b* extending along the Y-axis from the free end of the stiff arm 19, in extension of the stiff arm 19 to a stiff support 11*c* which bears the monostable elastic member 11*a*. The monostable elastic member 11*a* can extend along the Y-axis in the direction of the regulator 12, from the stiff support 11*c*. The monostable elastic member 11*a* serves such that the energy distribution member 10 transfers a precisely determined mechanical energy to the regulator, on each operating cycle of the clockwork movement 3, as explained in European patent application 14/197015 (EP 3,032,350).

The mechanism 13 further comprises a balancing member 25 which can be formed from one part with the frame 15 and which is carried on the frame 15 for oscillating parallel to the X-axis, in the translation direction O2. The balancing member 25 can for example comprise:

- a stiff body 26 extending parallel to the X-axis, symmetrically to the body 18 of the pallet about an axis of symmetry Y0 parallel to the aforementioned Y-axis;
- a stiff arm 28 extending along the Y-axis towards the regulator 12, symmetrically to the arm 24 of the pallet about the axis of symmetry Y0.

The balancing member 25 can also be inside the frame 15 and can be connected to the frame 15 by an elastic suspension, for example comprising two elastic branches 27 substantially parallel to the Y-axis and symmetric to the elastic branches 23 of the pallet 11. Potentially, the elastic branches 23 can be connected to the body 26 of the balancing member 25.

The pallet 11 and the balancing member 25 are each mounted on the frame 15 for oscillating in circular translation, with an oscillation amplitude in the translation direction O2 and a secondary oscillation amplitude, nonzero, perpendicular to the second translation direction. Said oscillation amplitude in the translation direction O2 is larger than the secondary oscillation amplitude of the pallet and of the balancing member, for example at least 10 times larger than the secondary oscillation amplitude of the pallet and of the balancing member.

The balancing member 25 can advantageously have a mass substantially identical to that of the pallet 11, for example included between 90% and 110% of the mass of the pallet 11. The mass of the balancing member is very close to that of the pallet but is not necessarily identical in order to allow for the fact that the stresses applied to one or the other of these members are not entirely symmetrical (for example the pallet is in contact with the energy distribution member whereas the balancing member is not).

The regulator 12 is a mechanical oscillator comprising first and second regulating members 29, 30, each forming a stiff inertial mass, and each connected to the frame 15 by an elastic suspension which is suited so that the first and second regulating members 29, 30 oscillate along the Y-axis, in a translation direction O1.

The elastic suspension is formed by the set of elastic links 31; 36, 55 which connect (directly or indirectly) the first and second regulating members 29, 30 to the frame 15. This elastic suspension has some overall stiffness, on which depends the oscillation frequency f of the first and second regulating members 29, 30.

The elastic suspension of the first and second regulating members 29, 30 can for example comprise two elastic branches 31 for each regulating member 29, 30 that extend substantially along the X-axis and are connected to the frame 15.

Each of the first and second regulating members 29, 30 is therefore mounted on the frame 15 for oscillating in circular translation, with a first oscillation amplitude in the translation direction O1 and a secondary oscillation amplitude, nonzero, perpendicular to the translation direction O1. Said oscillation amplitude in the translation direction O1 is larger than the secondary oscillation amplitude of the first and second regulating members, for example at least 10 times larger than the secondary oscillation amplitude.

In the example shown, the first and second regulating members 29, 30 can each have a C shape, with the main body 32 extending along the Y-axis between two lateral arms 33 extending towards the inside of the frame 15. The aforementioned elastic branches 31 can advantageously be connected to the free ends of the lateral arms 33, which would allow having elastic branches 31 that are long and therefore particularly flexible.

The first and second regulating members 29, 30 can be two parts symmetric about the aforementioned axis of symmetry Y0, with identical or substantially identical mass. Between them they can define a free central space 34.

The first and second regulating members 29, 30 can be connected respectively to the pallet 11 and to the balancing member 25, for example by elastic drive branches 36. Thus, the first regulating member 29 commands the movements of the pallet 11 and the second regulating member 30 commands the movements of the balancing member 25.

The elastic drive branches 36 can for example extend substantially along the X-axis. The elastic drive branches 36 can in particular be connected respectively to the free ends of the stiff arm 24 of the pallet and the stiff arm 28 of the balancing member.

Possibly, each of the first and second regulating members 29, 30 may comprise a notch 35 open along the X-axis between the main body 32 and the stiff arm 33 closest to the pallet 11 or balancing member 25, and the corresponding elastic drive branch 36 may be connected to the main body 32 at the bottom of said notch 35, which allows lengthening the elastic drive branches 36 and therefore increasing the flexibility thereof.

A stiff balancing lever 37, mounted pivoting around a central rotation center P, is arranged in the free inner space 34. The balancing lever 37 may possibly have a substantially M shape, with the central V shaped part 38 separating from the center of rotation P and two lateral arms 39.

The lateral alarms 39 can be respectively connected to the first and second regulating members 29, 30, for example by two elastic branches 40 extending substantially along the Y-axis.

The balancing lever 37 can be mounted, by an elastic suspension 43, on a stiff support 40*a* stiffly connected to the frame 15. The stiff support 40*a* can for example comprise an arm 41 extending along the axis of symmetry Y0, from the frame 15 to a head 42 which can for example extend along the X-axis by giving a T shape to the support 40*a*.

The elastic suspension 43 can for example comprise:

- a stiff pivoting member 44 arranged inside the balancing lever 37, comprising for example a central core 45 near the center of rotation P and extending along the X-axis between two enlarged heads 46;
- two intermediate stiff bodies 47, 48 arranged on either side of the central core 45 near the center of rotation P;
- two elastic branches 49 respectively connecting the free ends of the head 42 of the stiff support 41 to the stiff intermediate body 47;
- two elastic branches 50 connecting respectively the stiff intermediate body 47 to one of the free ends of the enlarged heads 46;
- two elastic branches 51 symmetric to elastic branches 50 connecting respectively the stiff intermediate body 48 to one of the free ends of the enlarged heads 46;
- two elastic branches 52 connecting the stiff intermediate body 48 respectively to the ends of the central part 38 of the balancing lever.

Figure 4:
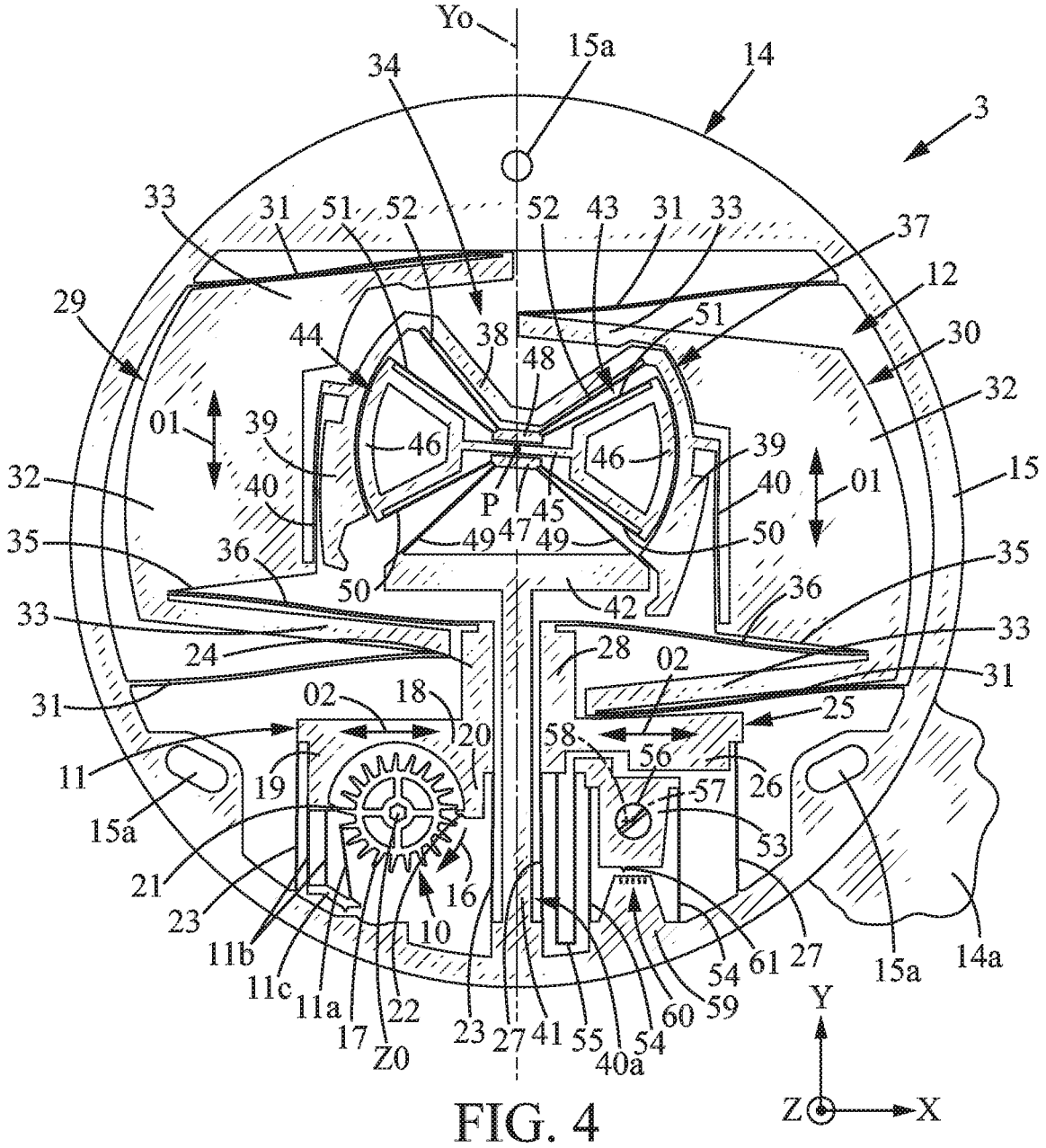
FIGS. 4 and 5 are views similar to FIG. 3, showing various positions of the mechanism.
Figure 5:
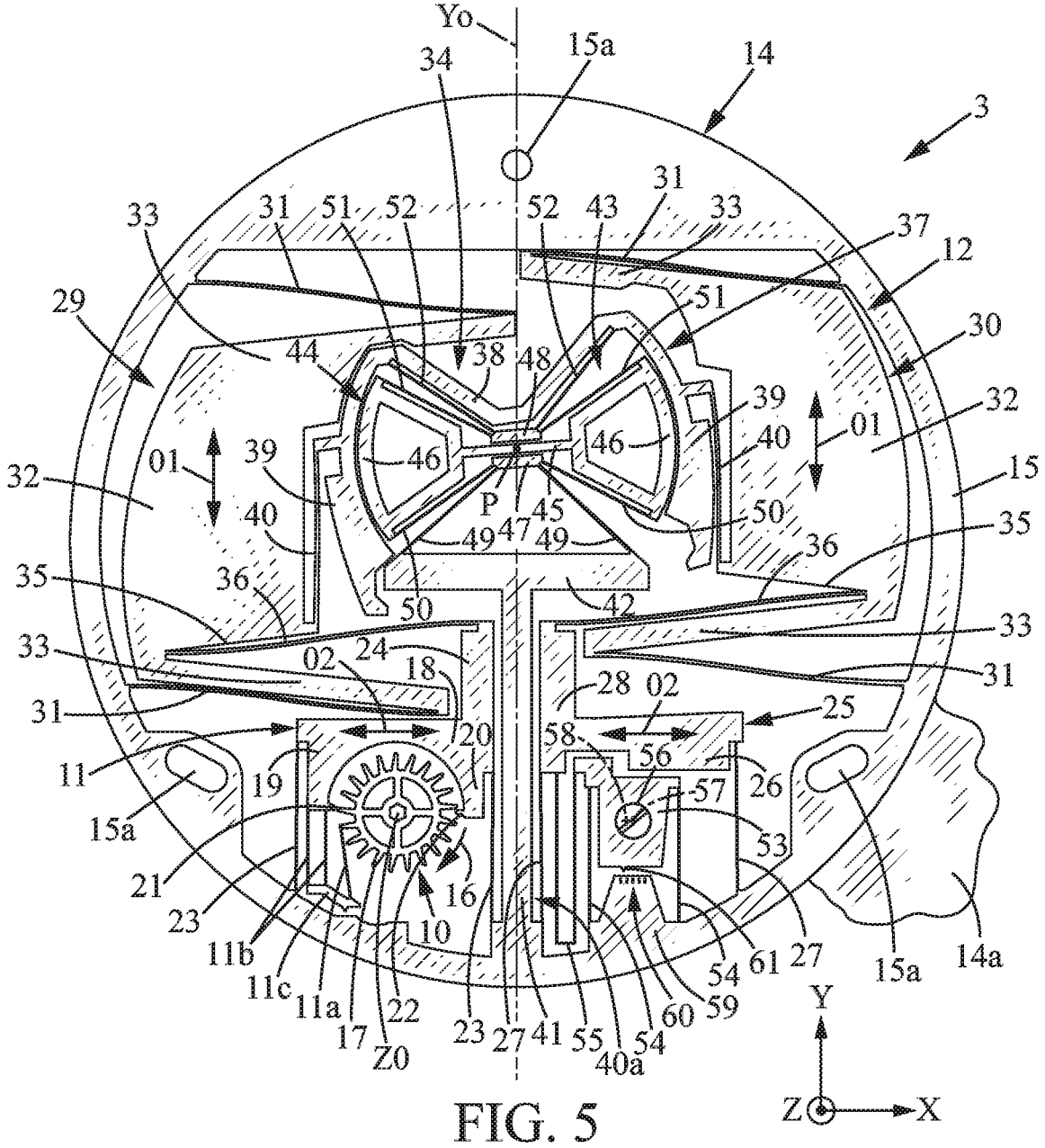

The balancing lever 37 compels the first and second regulating members 29, 30 to move symmetrically and oppositely along the translation direction O1, which, via the elastic drive branches 36, compels the pallet 11 and the balancing member 25 to move symmetrically and oppositely along the translation direction O2, as shown in FIGS. 4 and 5 which show the two end-of-range positions of the mechanism 13.

With these opposing movements, a dynamic balancing of the mechanism 13 is possible, in this way the sensitivity of the mechanism 13 to shocks, gravity and more generally to accelerations can be reduced.

The mechanism 13 further comprises a frequency adjustment device comprising a frequency adjustment member 53, with which to finely adjust the oscillation frequency of the regulator 12, in particular during mounting of the movement 3. The frequency adjustment member 53 can for example be formed from a single part in the plate 14 with the other members of the aforementioned mechanism 13.

The frequency adjustment member 53 is connected, directly or indirectly, to at least one other regulating member 29, 30 by an elastic link described as adjustment 36, 55. The frequency adjustment member 53 is furthermore adjustable in position relative to the support plate 14*a* and the frame 15 so as to be able to deform the elastic adjustment link 36, 55 and thus apply an adjustable elastic stress on the regulating member in question, so as to influence the overall stiffness of the elastic suspension of the regulator 12, and therefore the aforementioned frequency f.

The frequency adjustment member 53 can for example be connected to the frame 15 by two elastic branches 54 extending along the Y-axis.

Figure 3A:
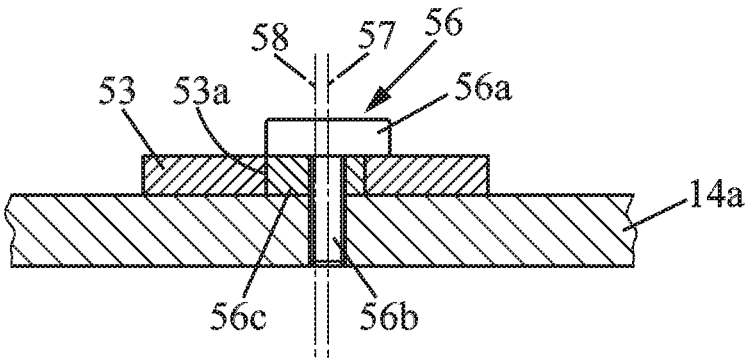
FIG. 3A is a detailed view in section along the line A-A from FIG. 3.
Figure 3:
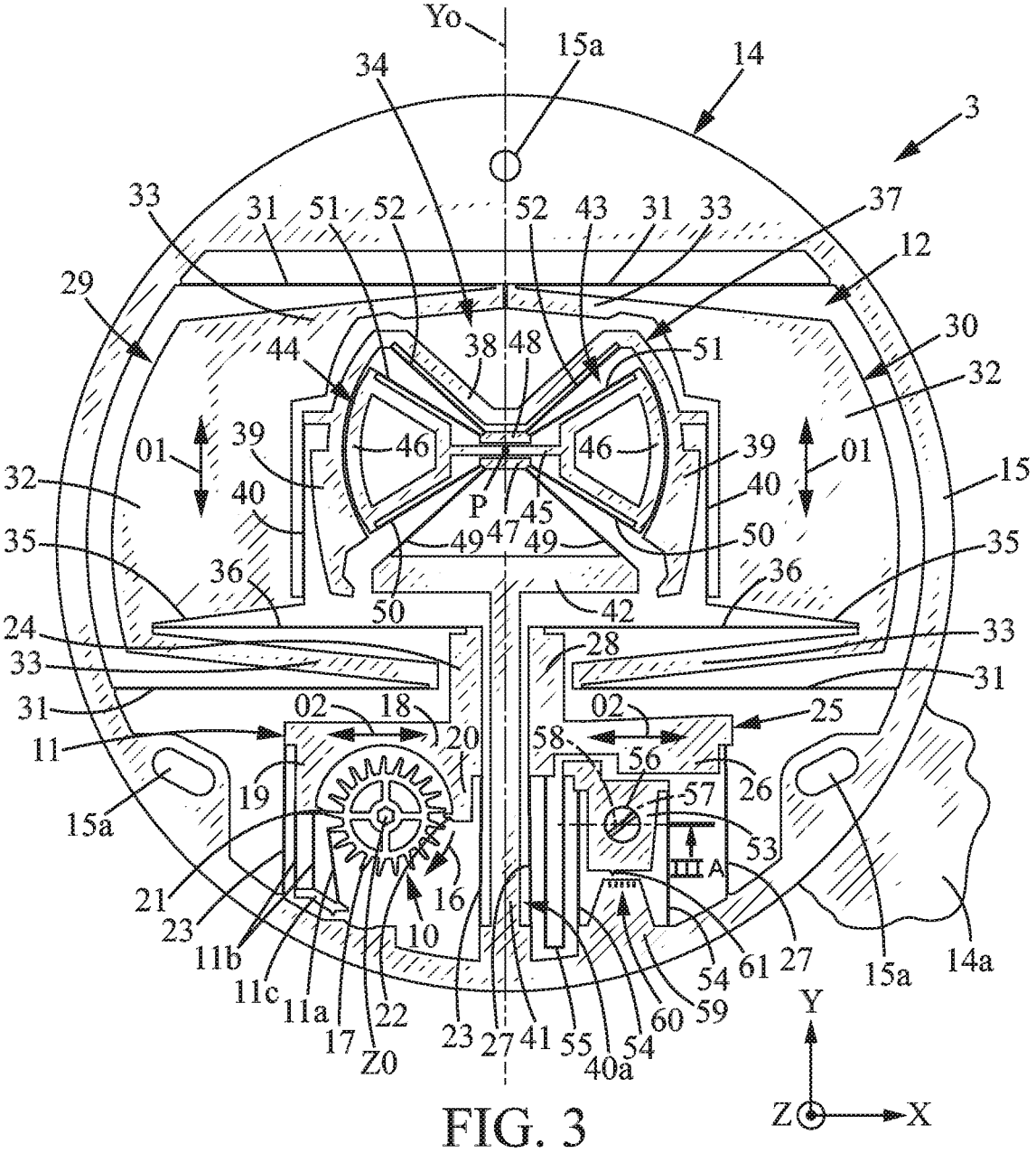
FIG. 3 is a plane view of a part of the movement from FIG. 2, comprising the regulator, pallet, balancing member, frequency adjustment member and the energy distribution member, according to a first embodiment of the invention.

In the example shown in FIG. 3, the elastic adjustment link 36, 55 comprises two elastic parts:

- a first elastic part formed by the elastic branch 36 connecting the second regulating member 30 to the balancing member 25;
- and a second elastic part 55 connecting the balancing member 25 to the frequency adjustment member 53.

The second elastic part 55 may comprise at least one U-shaped part, or be constituted by a U. In this case, the elastic link 55 can comprise two branches substantially parallel to the Y-axis which are connected to each other at an end close to the frame 15, and whose free ends are connected respectively to the frequency adjustment member 53 and to the balancing member 25.

The frequency adjustment member 53 is mounted movable relative to the frame 15 and to the support plate 14*a*, at least parallel to the X-axis, for example by means of the aforementioned elastic branches 54. The frequency adjustment member 53 comprises a blocking device 56 suited for blocking the frequency adjustment member 53 relative to the support plate 14*a*, and therefore relative to the frame 15. The blocking device can include for example a screw 56 screwed into the support plate 14*a* around an axis 58.

More specifically, in the example considered, as shown in FIGS. 3 and 3A, the frequency adjustment member 53 can be connected to the support plate 14*a* by an eccentric link, which can comprise for example a disk-shaped eccentric cam 56*c*, through which the stem 56*b* of the screw 56 passes, whereas the head 56*a* of the screw 56 comes to bear on said eccentric cam 56*c* to block it. The eccentric cam 56*c* is centered on an axis 57 offset from the axis 58 of the screw 56.

Advantageously, the adjustment member 53 and the frame 15 (or the support plate 14*a*) comprise facing indexes 60, 61 suited for visually assessing the position of the adjustment member 53 relative to the frame 15. In the example shown, the frame 15 comprises a projection 59 comprising a rectilinear edge provided with several indexes facing the frequency adjustment member 53, and the frequency adjustment member 53 comprises a point 61 or the like facing the indexes 60.

On FIG. 3, the eccentric cam 56*c* is in the position where the frequency adjustment member 53 is the closest to the pallet 11 and does not impose an elastic preload on the balancing member 25. The frequency f of the regulator 12 is then maximal.

The previously described mechanism operates according to the principle explained in the aforementioned European patent application 14/197015 (EP 3,032,350). In the following explanation of this operation, the concepts of top/bottom left/right are used to clarify the description in light of the orientation of the drawings from FIGS. 3 to 5, but these indications are not limiting.

In the situation from FIG. 3, the pallet 11 is in an extreme "right" position imposed by the elastic transmission branch 36 and the energy distribution member 10 comes to pivot under the effect of the energy storage device 8, and during this movement the monostable elastic member 11*a* deflects and then releases by transmitting the mechanical energy thereof to the regulator 12, as explained in the aforementioned European patent application 14/197015. The tooth 17 of the energy distribution member located towards the left in FIG. 3 is then stopped against the stop member 21 located on the left of the pallet 11. The elastic branches 31 are in resting position.

The first and second regulating members 29, 30 oscillate in the translation direction O1 between the two extreme positions shown respectively in FIGS. 4 and 5, where the frequency f can be included for example between 20 and 30 Hz.

In a semi-cycle of movement, for example when the first regulating member 29 moves from the extreme "top" position of FIG. 4 to the extreme "bottom" position from FIG. 5, the second regulating member 30 moves from the extreme "bottom" position from FIG. 4 to the extreme "top" position from FIG. 5, because of the balancing lever 37. During this time, the pallet 11 moves from the extreme "left" position from FIG. 4 to the extreme "right" position from FIG. 3 at the moment when the first and second regulating members moved to the neutral position from FIG. 3, and then the pallet 11 continues towards the left 5 to the extreme "left" position from FIG. 5, where the energy distribution member 10 again escapes and turns one step under the urging of the energy storage mechanism 8. During this time, the balancing member 25 follows a movement symmetric and opposite to the pallet 11.

The pallet 11 and the balancing member 25 therefore oscillate with a frequency 2*f* in the translation direction O2.

Figure 6:
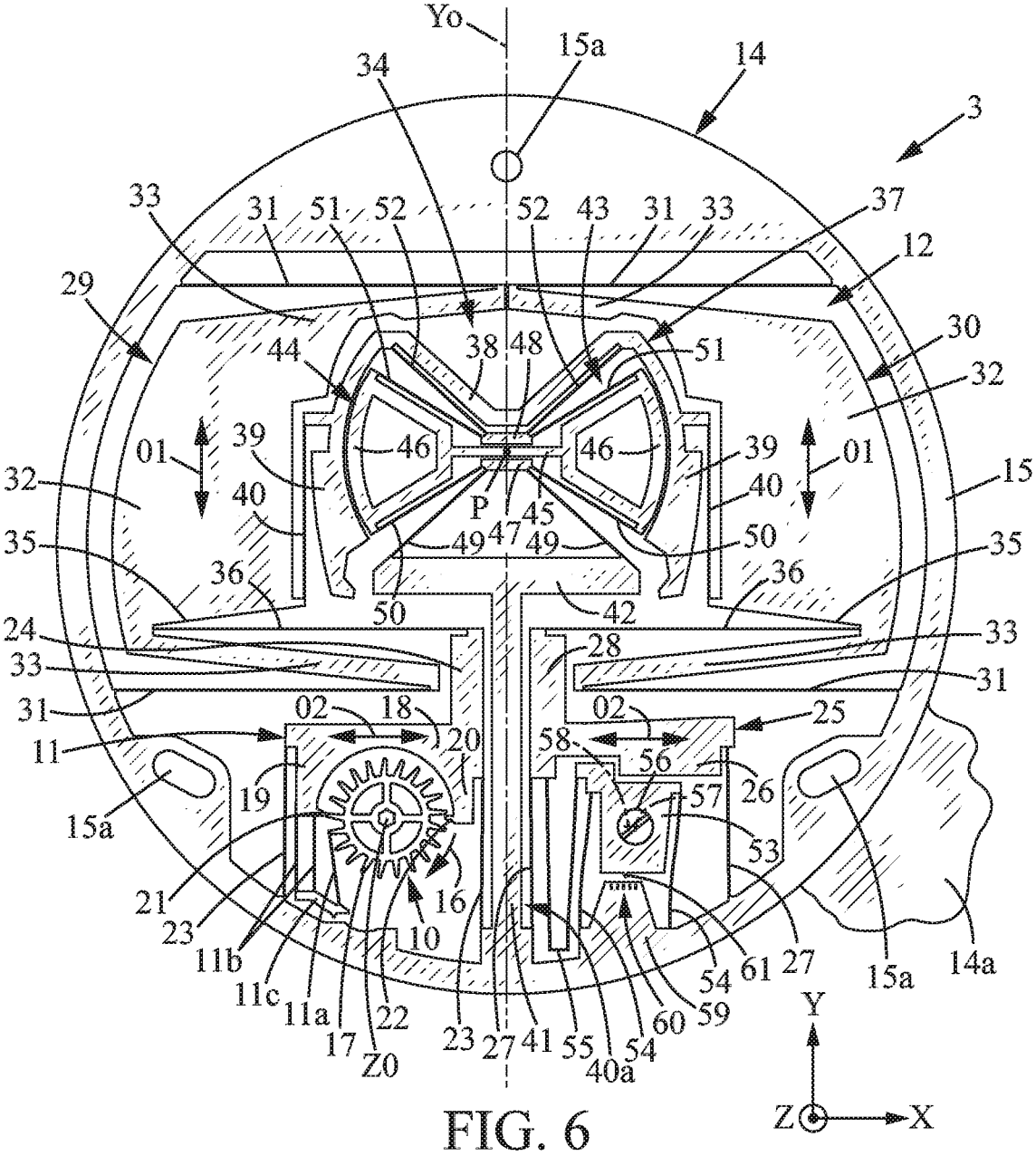
FIG. 6 is a view similar to FIG. 3 in another position of the frequency adjustment member.

The operation is the same when next moving from the position from FIG. 5 to the position from FIG. 4. The aforementioned steps are then repeated indefinitely. When it is necessary to perform a fine adjustment of the frequency f of the regulator, for example upon initial mounting of the movement 3 or after maintenance, an operator can loosen the screw 56 and adjust the position of the frequency adjustment member 53, manually or by automated means, until obtaining the exact desired frequency (measured by conventional means, notably optical), possibly by guiding with the indexes 60, 61. In the position from FIG. 6, the frequency adjustment member 53 is in the extreme position thereof farthest from the pallet 11 (meaning the position farthest to the right in FIG. 6), such that the second elastic part 55 imposes a stress towards the right on the balancing member 25, thus modifying the oscillation frequency f of the system.

Figure 7:
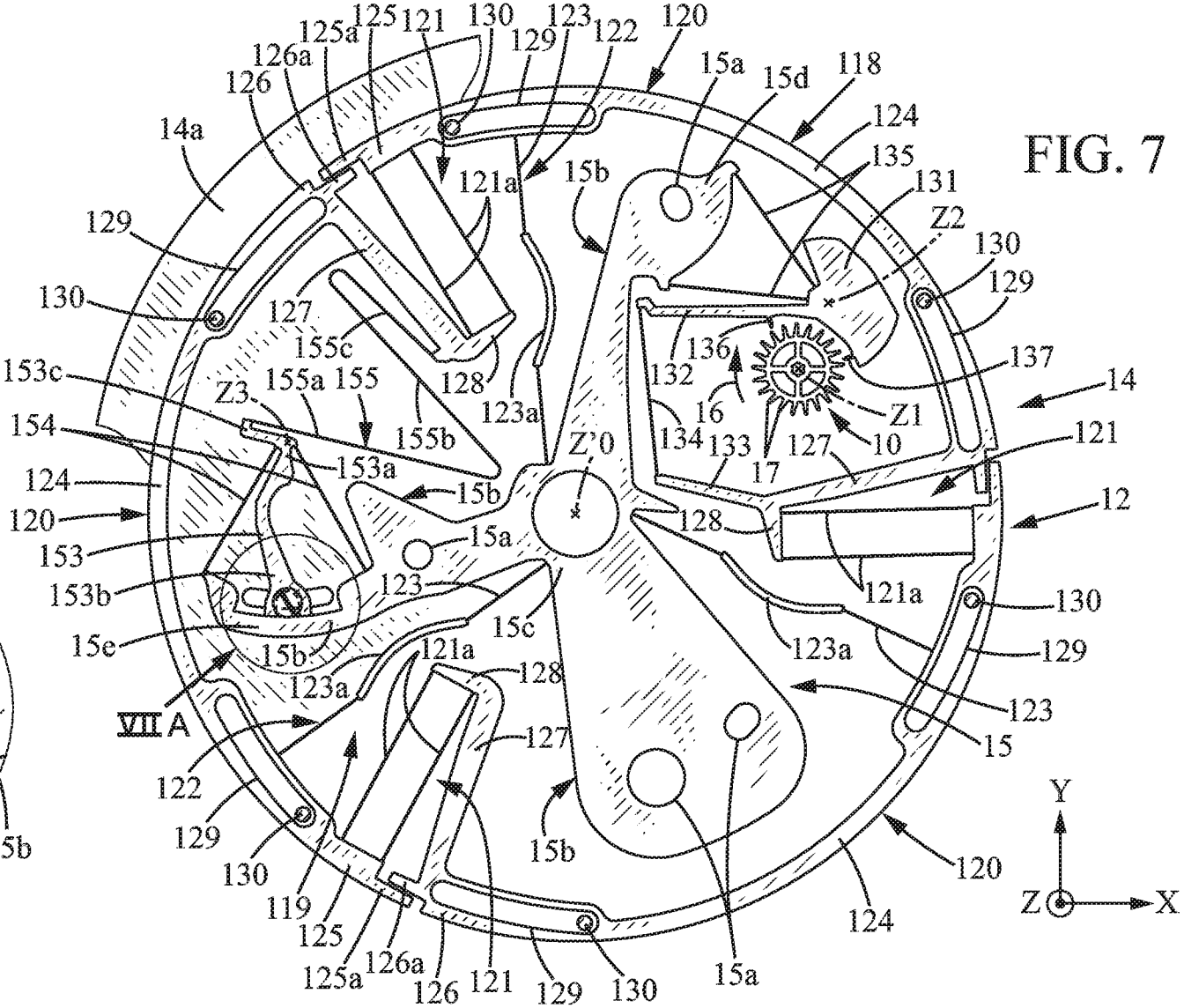
FIG. 7 is a view similar to FIG. 3 in a second embodiment of the invention.
Figure 7A:
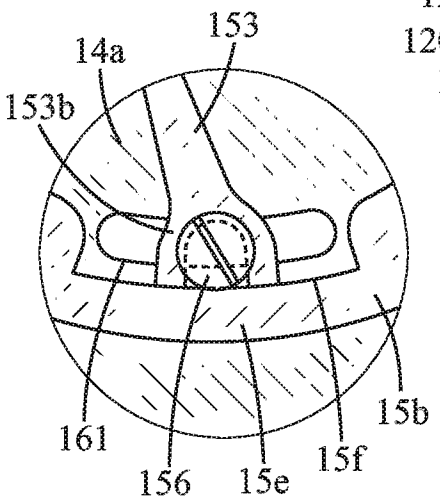
FIG. 7A is an enlarged view of the detail VII A from FIG. 7.

In the second embodiment of the invention, shown in FIGS. 7 and 7A, the above explanations relating to FIGS. 1 and 2 remain valid.

The pallet 11 and the regulator 12 form an advantageously monolithic mechanism 13, formed in a single plate 14 (usually flat) and for which the mobile parts are designed to move essentially in a median plane of said plate 14. The explanations about the plate 14 given relating to the first embodiment remain valid in the second embodiment.

The plate 14 comprises frame 15 which is secured to a support plate 14*a*, for example by screws or the like (not shown) passing through holes 15*a* of the support 15. The support plate 14*a* is securely joined to the case 2 of the timepiece 1.

The energy distribution member 10 can be an escapement wheel rotationally mounted for example on the support plate 14*a*, so as to be able to turn around a rotation axis Z1 perpendicular to the XY plane of the plate 14. The energy distribution member 10 is urged in a single direction of rotation 16 by the energy storage device 8.

The energy distribution member 10 has outer teeth 17.

The regulating member 118 of the regulator 12 is connected to the support 15 by an elastic suspension 119 connecting said regulating member to the support. More specifically, said regulating member 118 can have substantially an axial symmetry of order n about a central axis Z'0 orthogonal to the XY-plane and fixed relative to the support 15. By "have substantially an axial symmetry of order n," it is understood that the regulating member 118 is essentially conformed to this symmetry, but that some parts of relatively negligible mass might not have this symmetry (for example parts serving to couple the pallet with the regulating member).

Said regulating member 118 comprises a number of stiff portions n connected together pairwise by n elastic coupling links, where n is an integer at least equal to 2.

The elastic suspension 119 has n elastic suspension links connecting respectively each stiff portion of the regulating member to the support 15.

In particular, the elastic suspension can be provided such that the regulating member 118 is substantially mobile in rotation around the central axis Z'0.

Advantageously, the number n is equal to 3; it can just the same be equal to 2 or more than 3. When the number n is 3 or more, each stiff portion of the regulating member 118 is connected to two adjacent stiff portions of the regulating member respectively by two elastic coupling links.

The regulating member 118 of the regulator 12 can have a general annular shape centered on the central axis Z'0 and comprise 3 stiff portions 120 connected pairwise between them by 3 elastic coupling links 121.

The elastic suspension 119 which connects the regulating member 118 of the regulator 12 to the support 15 comprises 3 elastic suspension links 122 respectively linking each stiff portion 120 to the support 15 such that each stiff portion 120 is mobile with a movement at least of rotation around the central axis Z'0, where the regulating member 118 has an overall movement substantially of rotation around the central axis Z'0.

Each elastic suspension link 122 advantageously comprises at least one elastic branch 123, for example one elastic branch 123. Each elastic branch 123 can possibly comprise a stiff segment 123*a*, for example towards the center of said elastic branch 123.

Because the elastic branches 123 deflect during the rotation of the regulating member, the stiff portions 120 of the regulating member are mobile both in rotation and in radial translation about the central axis Z'0.

The support 15 can possibly have a substantially star shape, with three branches 15*b* connected by a central part 15*c* near the axis Z'0.

The stiff portions 120 of the regulating member 118 can each comprise a part 124 with circular-arc shape centered on the central axis Z'0. The circular-arc shaped parts 124 are neighbors of each other and together form a discontinuous ring centered on the central axis Z'0.

Each elastic branch 123 can extend substantially radially relative to the central axis Z'0 and connect the circular-arc shaped part 124 of one of the stiff portions 120 to the aforementioned central portion 15*c* of the support 15.

The circular-arc shaped parts 124 each extend angularly between a first end 125 and a second end 126 which mutually overlap in the angular direction. For example, each first end 125 can form a first finger 125*a* extending towards the adjacent stiff portion 120 and each second end 126 can form a second finger 126*a* extending towards the adjacent stiff portion 120, where each first finger portion 125*a* overlaps the second finger 126*a* of the adjacent stiff portion 120 towards the outside.

The second end 126 of each circular-arc shape part 124 can be extended substantially radially towards the inside by a stiff arm 127 terminated by a beak 128 extending angularly beyond the second end, in the direction of the adjacent stiff portion 120.

Each elastic coupling link 121 may comprise at least one elastic coupling branch 121*a* (here two parallel elastic coupling branches 121*a*) extending substantially radially relative to the central axis Z'0 and connecting the beak 128 of each stiff portion 120 to the first end 125 of the circular-arc part 124 of the adjacent stiff portion 120.

The travel of each stiff portion 120 of the regulating member can be limited by means for limiting movement relative to the support 15, for limiting the travel, in particular angular, of the stiff portions 120 and protecting the mechanism 13 in particular in case of shock or more generally when it experiences strong accelerations.

These means for limiting movement can comprise a slit 129 laid-out in each circular-arc part 124 and extending angularly around the central axis Z'0, and the pin 130 which is rigidly connected with the support 15 (in fact, fixed to the support plate 14A) and which is arranged in the slit 129. The slits 129 are shaped according to the kinetics of the stiff portions 120 during the rotational movement of the regulating member 118. The slits 129 therefore do not have a circular shape centered on the central axis Z'0, but instead here have a spiral segment shape.

The pallet 11 and the energy distribution member 10 can be arranged inside the regulating member 118.

The pallet 11 is a stiff part which can comprise a stiff body 131 near the circular-arc part 124 of one of the stiff portions 120 of the regulating member. The pallet 11 can additionally comprise a stiff drive arm 132 which is rigidly connected with the stiff body 131 and which extends from one of said stiff bodies 131 towards one of the branches 15*b* of the support.

The pallet 11 is elastically connected to the support 15, so as to be able to oscillate, for example according to a substantially rotational movement about an axis Z2 perpendicular to the XY plane. The oscillations of the pallet 11 are commanded by the regulating body 118.

For that purpose, the stiff arm 127 of one of the stiff portions 120 of the regulating member can be extended inward by an additional stiff arm 133 whose free end is connected to the free end of the stiff drive arm 132 by an elastic drive branch 134.

Advantageously, the pallet 11 can be connected to the support 15 by an elastic suspension, comprising for example two elastic branches 135 for pallet suspension converging substantially towards the axis Z2. Possibly, the elastic branches 135 can connect the stiff body 131 to the free end 15*d* of one of the branches 15*b* of the support.

The pallet 11 comprises two stop members 136, 137, shaped like tabs projecting substantially towards the Z1 axis, which are suited for engaging with the energy distribution member 10.

The pallet 11 is thus commanded by said regulating member 118 for regularly and alternately blocking and releasing the energy distribution member 10 by means of stop members 136, 137, such that said energy distribution member 10 moves stepwise in the direction 16 under the urging of the energy storage device 8 in a cycle of repetitive movement, and said pallet 11 is further suited for transferring the mechanical energy to the regulating body 118 during this repetitive movement cycle, in a well-known way.

In the sample implementation, the total mass of the oscillating parts of the mechanism can be about 0.33 g and their inertia about $20.19\times10^{-9}$ kg·m$^2$; the oscillating frequency of the regulating member 118 is about 18 Hz and the rotational stiffness of the mechanism is about $2.58\times10^{-4}$ Nm/rad. Such a mechanism has a very good isochronism, which leads to a very good time precision.

The mechanism 13 additionally comprises a frequency adjustment device with which to adjust the aforementioned frequency f. This frequency adjustment device comprises a stiff frequency adjustment member 153, with which to finely adjust the oscillation frequency of the regulator 12, in particular during mounting of the movement 3. The frequency adjustment member 153 can for example be formed from a single part in the plate 14 with the other members of the aforementioned mechanism 13.

The frequency adjustment member 153 is connected, directly or indirectly, to at least one of the stiff portions 120 of the regulating member 118 by an elastic link referred to as adjustment 155. The frequency adjustment member 153 is furthermore adjustable in position relative to the support plate 14*a* and the support 15 so as to be able to deform the elastic adjustment link 155 and thus apply an adjustable elastic stress on the regulating member 118, so as to influence the overall stiffness of the elastic suspension of the regulator 12, and therefore the aforementioned frequency f.

The frequency adjustment member 153 can have an elongated shape extending between a first end 153*a* and a second end 153*b*. The frequency adjustment member 153 can be arranged inside the regulating member 118, for example between one of the branches 15*b* of the support 15 and one of the aforementioned stiff arms 127. The second end 153*b* can possibly have a fork shape or comprise a hole for passage for an adjustment screw 156. The second end 153*b* can possibly be arranged facing a notched part 15*e* of the adjacent branch 15*b* of the support.

The frequency regulating member 153 can for example be connected to one of the branches 15*b* of the support 15 by two elastic branches 154. The elastic branches 154 may converge towards the first end 153*a*, which thus defines a pivoting axis Z3 of the frequency adjustment member 153 (perpendicular to the aforementioned XY plane). The notched part 15*e* of the branch 15*b* adjacent to the frequency adjustment member 153 may advantageously have an edge 15*f*, that is substantially circular and centered on the pivoting axis Z3, which may possibly be substantially in contact with the second end 153*b* of the frequency adjustment member 153 and thus contribute to guiding the frequency adjustment member 153 when the position thereof is adjusted. The notched part 15*e* of the branch 15*b* in question can possibly comprise indexes 60 such as described in the first embodiment.

In the example shown in FIGS. 7 and 7A, the frequency adjustment member 153 comprises a lever arm 153*c* which extends the first end 153*a* opposite from the second end 153*b*. This lever arm 153*c* can extend with some angle relative to the main body of the frequency adjustment member 153 (meaning the part included between the first and second ends 153*a*, 153*b*), for example with an angle of about 90°. The lever arm 153*c* is advantageously shorter than the main body of the frequency adjustment member 153, for example 3 to 6 times shorter, which allows a movement of the first end 153*a* to induce a relatively smaller movement of the free end of the lever arm 153*c*.

The elastic adjustment link 155 can connect the free end of the lever arm 153*c* to the regulating member 118, for example to the free end of the stiff arm 127 adjacent to the frequency adjustment member 153.

In the example shown, this elastic adjustment link 155 can comprise three elastic branches 155*a*, 155*b*, 155*c*, comprising a first elastic branch 155*a* leaving from the free end of the lever arm 153*c* and extending to a first elbow, the second elastic branch 155*b* extending from the first elbow to a second elbow and the third elastic branch 155*c* extending from the third elbow to the free end of the aforementioned stiff arm 127.

The frequency adjustment member 153 can be adjusted by pivoting the second end 153*b* thereof around the pivoting axis Z3 and then held in position by the aforementioned adjustment screw 156. The adjustment screw 156 can for example pass through a circular-arc shaped slot 161 arranged in the support plate 14*a*. This slot can have a substantially circular-arc shape centered on the pivoting axis Z3. The adjustment screw 156 can for example be screwed into a nut (not shown) placed under the support plate 14*a*. The adjustment and holding in position of the frequency adjustment member 153 could be done by any other means such as eccentric connection or other.

When it is necessary to perform a fine adjustment of the frequency f of the regulator, for example upon initial mounting of the movement 3 or after maintenance, an operator can loosen the adjustment screw 156 and adjust the position of the frequency adjustment member 153, manually or by automated means, until obtaining the exact desired frequency (measured by conventional means, notably optical).

The invention claimed is:

1. A device for timepieces comprising a monolithic mechanism which comprises:

a support;

at least one inertial regulating member;

an elastic suspension linking said at least one inertial regulating member to the support and having a specific overall stiffness;

where said at least one inertial regulating member is suited to oscillate at a frequency f relative to the support;

wherein the elastic suspension comprises an elastic adjustment link having a first end linked to said at least one inertial regulating member and a second end which is directly connected to the support by a frequency adjustment device suited to modify the position of the second end of said elastic adjustment link relative to the support, so as to change the overall stiffness of the elastic suspension and therefore said frequency f.

2. The device according to claim 1, wherein the frequency adjustment device includes a frequency adjustment member which is linked to the second end of said elastic adjustment link, where said frequency adjustment member is adjustable in position relative to the support so as to be able to deform said elastic adjustment link.

3. The device according to claim 2, wherein said frequency adjustment member is mounted movably relative to the support and comprises a blocking device suited to block the frequency adjustment member relative to the support.

4. The device according to claim 2, wherein the adjustment member and the support comprise facing indexes suited for visually assessing the position of the adjustment member relative to the support.

5. A clockwork movement comprising a device according to claim 1 and an energy distribution member.

6. A timepiece comprising a clockwork movement according to claim 5.

7. A device for timepieces comprising a monolithic mechanism which comprises:

a support;

at least one inertial regulating member;

an elastic suspension linking said at least one inertial regulating member to the support and having a specific overall stiffness;

where said at least one inertial regulating member is suited to oscillate at a frequency f relative to the support;

wherein the elastic suspension comprises an elastic adjustment link having a first end linked to said at least one inertial regulating member and a second end which is connected to the support by a frequency adjustment device suited to modify the position of the second end of said elastic adjustment link relative to the support, so as to change the overall stiffness of the elastic suspension and therefore said frequency f, wherein the frequency adjustment device includes a frequency adjustment member which is linked to the second end of said elastic adjustment link, where said frequency adjustment member is adjustable in position relative to the support so as to be able to deform said elastic adjustment link, wherein said frequency adjustment member is mounted movably relative to the support and comprises a blocking device suited to block the frequency adjustment member relative to the support, and wherein said blocking device comprises a screw.

8. The device according to claim 7, wherein said frequency adjustment member is connected to the support by an eccentric link suited to be blocked by said screw.

9. A device for timepieces comprising a monolithic mechanism which comprises:

a support;

at least one inertial regulating member;

an elastic suspension linking said at least one inertial regulating member to the support and having a specific overall stiffness;

where said at least one inertial regulating member is suited to oscillate at a frequency f relative to the support, wherein the elastic suspension comprises an elastic adjustment link having a first end linked to said at least one inertial regulating member and a second end which is connected to the support by a frequency adjustment device suited to modify the position of the second end of said elastic adjustment link relative to the support, so as to change the overall stiffness of the elastic suspension and therefore said frequency f, and wherein the monolithic mechanism additionally comprises a pallet suited for engaging with an energy distribution member provided with teeth and intended to be urged by an energy storage device, where said pallet is controlled by said at least one inertial regulating member for uniformly and alternately blocking and releasing the energy distribution member, such that said energy distribution member moves stepwise under the urging of said energy storage device according to a repetitive movement cycle, and where said pallet is suited for transferring mechanical energy to at least one inertial regulating member during this repetitive movement cycle.

10. The device according to claim 9, comprising first and second inertial regulating members connected to each other so as to always have symmetrical and opposed movements, wherein:

the first inertial regulating member controls the pallet, the second inertial regulating member controls a balancing member for moving said balancing member according to movements symmetrical and opposed to the pallet, and said elastic adjustment link comprises at least one of the first and second elastic parts, with the first elastic part connecting the second inertial regulating member to the balancing member and with the second elastic part connecting said balancing member to the frequency adjustment device.

11. The device according to claim 10, wherein the first and second inertial regulating members are mounted on the support in order to oscillate in translation in a first translation direction, the pallet and the balancing member are elastically mounted on the support in order to oscillate in translation in a second translation direction substantially perpendicular to the first translation direction, and the frequency adjustment device is suited for adjusting the position of the second end of the elastic adjustment link relative to the support at least parallel to the second translation direction.

12. The device according to claim 11, wherein each of the first and second inertial regulating members is mounted on the support by two elastic suspension branches substantially perpendicular to the first translation direction, where the pallet and the balancing member are respectively mounted on the support by two elastic suspension branches substantially perpendicular to the second translation direction.

13. The device according to claim 11, wherein said second elastic part of the elastic adjustment link comprises at least one U-shaped part, comprising two branches substantially parallel to the first translation direction, having free ends which are connected respectively to the frequency adjustment member and the balancing member.

14. The device according to claim 10, wherein the first and second inertial regulating members are connected to each other by a pivoting balancing lever.

15. The device according to claim 10, wherein the pallet and the balancing member are respectively linked to the first and second regulating members by first and second elastic drive branches.

16. A device for timepieces comprising a monolithic mechanism which comprises:

a support;

at least one inertial regulating member;

an elastic suspension linking said at least one inertial regulating member to the support and having a specific overall stiffness;

where said at least one inertial regulating member is suited to oscillate at a frequency f relative to the support;

wherein the elastic suspension comprises an elastic adjustment link having a first end linked to said at least one inertial regulating member and a second end which is connected to the support by a frequency adjustment device suited to modify the position of the second end of said elastic adjustment link relative to the support, so as to change the overall stiffness of the elastic suspension and therefore said frequency f, and wherein the mechanism extends along a median plane and the inertial regulating member substantially has an axial symmetry of order n about a central axis orthogonal to said median plane and fixed relative to the support, where n is an integer at least equal to 2, where said inertial regulating member comprises a number n of stiff portions connected to each other pairwise by n elastic coupling links, and where the elastic suspension comprises n elastic suspension links respectively connecting each stiff portion of the support.

17. A device for timepieces comprising a monolithic mechanism which comprises:

a support;

at least one inertial regulating member;

an elastic suspension linking said at least one inertial regulating member to the support and having a specific overall stiffness;

where said at least one inertial regulating member is suited to oscillate at a frequency f relative to the support;

wherein the elastic suspension comprises an elastic adjustment link having a first end linked to said at least one inertial regulating member and a second end which is connected to the support by a frequency adjustment device suited to modify the position of the second end of said elastic adjustment link relative to the support, so as to change the overall stiffness of the elastic suspension and therefore said frequency f, and wherein the frequency adjustment device comprises a frequency adjustment member mounted substantially adjustably by pivoting around a pivoting axis and having a main body extending between a first extremity located near the pivoting axis and a second extremity adjustable in position, where the frequency adjustment member additionally comprises a lever arm which extends from the first end to opposite from the second end, where the lever arm is linked to the second end of said elastic adjustment link, and where said lever arm is shorter than the main body of the frequency adjustment member.

* * * * *